US008488185B2

(12) United States Patent
Iijima

(10) Patent No.: US 8,488,185 B2
(45) Date of Patent: Jul. 16, 2013

(54) IMAGE WRITING APPARATUS AND IMAGE RECORDING APPARATUS HAVING A POSITIONING UNIT

(75) Inventor: Kiichiro Iijima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 822 days.

(21) Appl. No.: 12/626,029

(22) Filed: Nov. 25, 2009

(65) Prior Publication Data

US 2010/0271639 A1 Oct. 28, 2010

(30) Foreign Application Priority Data

Apr. 23, 2009 (JP) ..... 2009-105533

(51) Int. Cl.
*G06K 15/10* (2006.01)

(52) U.S. Cl.
USPC ..... 358/1.5

(58) Field of Classification Search
USPC ..... 358/1.1, 1.2, 1.5, 1.6
See application file for complete search history.

(56) References Cited

U.S. PATENT DOCUMENTS

2008/0145103 A1* 6/2008 Honobe et al. ..... 399/205

FOREIGN PATENT DOCUMENTS

| | | |
|---|---|---|
| JP | 07-195734 A | 8/1995 |
| JP | 2001-130047 A | 5/2001 |
| JP | 2008-143010 A | 6/2008 |

* cited by examiner

*Primary Examiner* — Jeremiah Bryar
(74) *Attorney, Agent, or Firm* — Sughrue Mion, PLLC

(57) ABSTRACT

According to an aspect of the invention, an image writing apparatus includes an image writing unit, a moving unit, a positioning unit. The image writing unit faces an image carrier or a support member supporting a recording medium and writes an image on the image carrier or the recording medium. The moving unit moves the image writing unit between a first position and a second position apart from the first position. A positioning unit sets the image writing unit in the first position and includes a first restriction member, a second restriction member, a third restriction member, and a restriction releasing portion. The first restriction member restricts a first movement of the image writing unit along a first direction from the image carrier to the image writing unit or from the support member to the image writing unit.

17 Claims, 8 Drawing Sheets

IMAGE WRITING APPARATUS AND IMAGE RECORDING APPARATUS HAVING A POSITIONING UNIT

CROSS-REFERENCE TO RELATED APPLICATIONS

This application is based upon and claims priority under 35 USC 119 from Japanese Patent Application No. 2009-10553, filed Apr. 23, 2009.

BACKGROUND

Technical Field

The present invention relates to an image writing apparatus and an image recording apparatus using the same.

SUMMARY OF THE INVENTION

According to an aspect of the invention, an image writing apparatus includes an image writing unit, a moving unit and a positioning unit. The image writing unit faces an image carrier or a support member supporting a recording medium and writes an image on the image carrier or the recording medium. The moving unit moves the image writing unit between a first position and a second position apart from the first position. A positioning unit sets the image writing unit in the first position and includes a first restriction member, a second restriction member, a third restriction member, and a restriction releasing portion. The first restriction member restricts a first movement of the image writing unit along a first direction from the image carrier to the image writing unit or from the support member to the image writing unit. The second restriction member restricts a second movement of the image writing unit along a second direction perpendicular to the first direction and an axial direction of the image carrier or the support member. The third restriction member restricts a third movement of the image writing unit along a third direction parallel to the axial direction. The releasing member releases the third movement after the image writing unit is set in the first position by the first to third restriction member.

BRIEF DESCRIPTION OF THE DRAWINGS

Exemplary embodiments of the invention will be described in detail based on the following figures, wherein.

DETAILED DESCRIPTION

Outline of Exemplary Embodiment

Figure 1A:
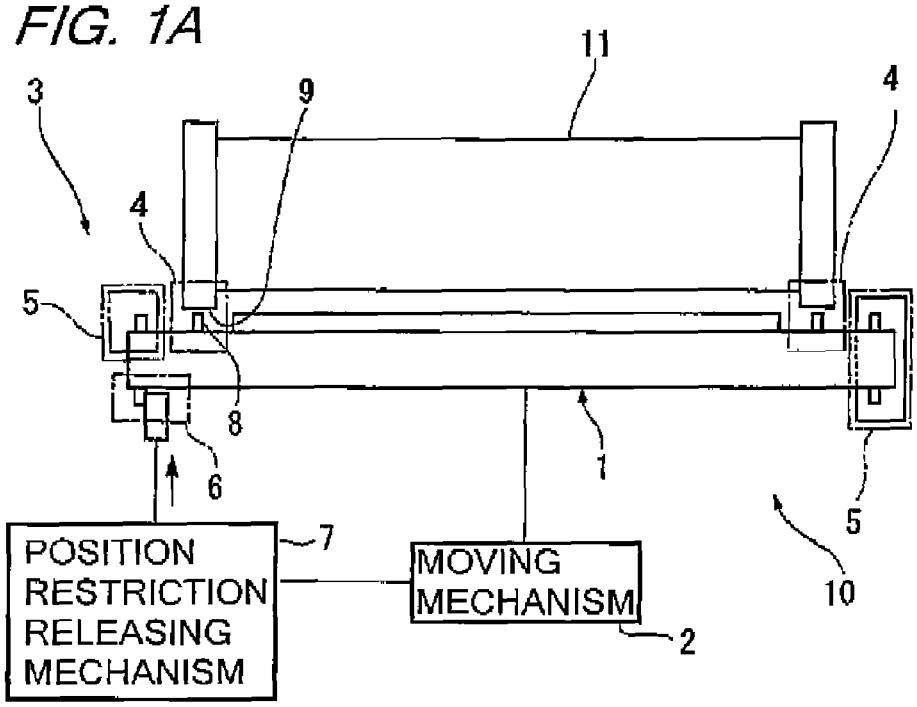
FIGS. 1A and 1B are explanatory views, FIG. 1A showing processes of a positioning operation in an outline of en exemplary embodiment of an image recording apparatus to which the present invention is applied, and FIG. 1B showing a state at a time of positioning in the outline of the exemplary embodiment.

FIG. 1A is an explanatory view showing an outline of an exemplary embodiment of an image recording apparatus to which the present invention is applied.

In FIG. 1A, the image recording apparatus is equipped with an image carrier 11 provided to a recording apparatus main body, and an image writing apparatus 10 for writing an image on the image carrier 11.

In the present exemplary embodiment, the image writing apparatus 10 includes an image writing unit 1 that is arranged to oppose to the image carrier 11 being provided to the recording apparatus main body and writes an image on the image carrier 11, a moving unit 2 that causes the image writing unit 1 to move to a position positioned with respect to the image carrier 11 and a standby position that is distant from this positioning position, and a positioning unit 3 that sets the image writing unit 1 in the position positioned with respect to the image carrier 11. Also, such positioning unit 3 has a first position restricting mechanism 4 for restricting a distance between the image carrier 11 and the image writing unit 1, a second position restricting mechanism 5 for restricting a position of the image writing unit 1 in the image moving direction of the image carrier 11, a third position restricting mechanism 6 for restricting a position of the image writing unit 1 in the width direction that intersects orthogonally with the image moving direction of the image carrier 11, and a position restriction releasing mechanism 7 for causing the third position restricting mechanism 6 to release a position restriction after the image writing unit 1 is net in the positioning position with respect to the image carrier 11 by the first to third position restricting mechanisms 4 to 6.

In such technical means, the LED printer head (the light irradiating image writing unit in which the light emitting elements (LEDs) are aligned every image unit along the width direction of the image carrier) employed in the electrophotography type image forming apparatus, for example, is typical of the image writing unit 1. But the image writing unit 1 is not limited to this type, and the ink jet type print head, for example, may also be employed.

Here, for example, the image carrier 11 denotes the photosensitive body in a mode that the image writing unit 1 is the LED printer head. Also, the image carrier 11 denotes a support member supporting the recording medium (a paper or an intermediate transfer medium) in a mode that the image writing unit 1 is the ink jet type print head.

Also, any moving unit 2 may be employed if such moving unit 2 may move the image writing unit 1 to the position positioned with respect to the image carrier 11 and the standby position. But the moving unit 2 is not limited to a mode that the moving unit 2 moves the image writing unit 1 back and forth between two positions, and the moving unit for moving the image writing unit 1 to other positions may be employed.

Further, the position restricting mechanisms 4 to 6 for restricting a distance to the image carrier 11, a position in the image moving direction of the image carrier 11 (corresponding to the rotation direction of the photosensitive body when the image carrier 11 is the photosensitive body), and a position in the width direction of the image carrier 11 (corresponding to the axial direction of the photosensitive body when the image carrier 11 is the drum-like photosensitive body) respectively are required of the positioning unit 3 of the image writing unit 1.

Also, the position restriction releasing mechanism 7 may be selected appropriately if such releasing mechanism 7 may move the position restricting element (e.g., the position restricted member or the position restricting member) of the third position restricting mechanism 6 from the position restriction position, and may release the position restricted state by the position restricting element.

Also, in the present exemplary embodiment, as the preferred mode of the moving unit 2, the moving unit for moving the image writing unit 1 such that the position of the image writing unit 1 may be restricted by the first position restricting mechanism 4 after the position of the image writing unit 1 is restricted by the second position restricting mechanism 5 and the third position restricting mechanism 6 may be listed. The order of the position restriction executed by the first to third position restricting mechanisms 4 to 6 may be selected appropriately. According to the present mode, a distance between the image carrier 11 and the image writing unit 1 may be restricted precisely as the first position restriction.

Further, as typical modes of respective position restricting mechanisms 4 to 6, such a mode may be listed that a position restricted member 8 is provided on the image writing unit 1 side and a position restricting member that the position restricted member 8 contacts is provided on the recording apparatus main body side on which the image carrier 11 is provided. Here, a position restricted projection is typical of the position restricted member 8, and a position restriction wall (containing an edge portion of a position restriction hole) is typical of the position restricting member 9.

Further, the mode in which a pushing member (not shown) for pushing the position restricted member 8 against the position restricting member 9 is provided is preferable as respective position restricting mechanisms 4 to 6. In the present mode, the position restricted member 8 is pushed against the position restricting member 9 by an pushing force applied from the pushing member, so that the image writing unit 1 is restricted precisely in respective position restriction positions by respective position restricting mechanisms 4 to 6.

Also, as the preferred mode of respective position restricting mechanisms 4 to 6, the mechanism in which the portion, which contacts the position restricting member, of the position restricted member is formed as a curved surface portion may be considered. In the present mode, the contact portion of the position restricted member being shaped into the curved surface portion is preferable from aspects that a contact surface to the position restricting member 9 is made small and correspondingly a position restriction is hard to be influenced by a surface property of the position restricting member 9.

Also, as the typical mode of the third position restricting mechanism 6, the mode in which the position restricted member 8 is provided on the image writing unit 1 side and the position restricting member 9 that the position restricted member 8 contacts and that becomes distant from the position restricted member 8 according to a displacement caused due to an elastic deformation, is provided on the recording apparatus main body side on which the image carrier 11 is provided may be considered. In the present mode, in addition that the position restricting member 9 is the functional member for position restriction, the function of causing the position restricting member 9 to release the position restricted member 8 according to a displacement due to the elastic deformation is provided as the function of enabling the release of position restriction.

Further, as the typical mode of the third position restricting mechanism 6, the mechanism for executing the position restricting operation and the position restriction releasing operation of the image writing unit 1 accompanying the moving operation of the image writing unit 1 produced by the moving unit 2 may be considered. In this case, when the third position restricting mechanism 6 is set in the mode in which a series of operations are executed according to the moving operation of the image writing unit 1 produced by the moving unit 2, another operation from the moving operation performed by the moving unit 2 is not needed in executing the position restriction releasing operation.

Also, as the position restriction releasing mechanism 7 for causing the third position restricting mechanism 6 to embody the position restricting operation and the position restriction releasing operation, the mechanism that has a releasing member (not shown) being moved together with the moving unit 2 and causes this releasing member to execute the position restriction releasing operation of the image writing unit 1 by the third position restricting mechanism 6 may be listed. In this case, when the position restriction releasing mechanism 7 is set in the mode in which the releasing member being moved together with the moving unit 2 is provided, the position restriction releasing mechanism 7 works along with the moving operation of the moving unit 2, and thus another operation from the moving operation performed by the moving unit 2 is not needed in executing the position restriction releasing operation.

Also, the image writing apparatus 10 according to the present exemplary embodiment may be described from the function aspect by the positioning unit 3 as follows.

That is, the image writing apparatus 10 according to the present exemplary embodiment may be described to include the image writing unit 1 that is arranged to oppose to the image carrier 11 being provided to the recording apparatus main body and writes an image on the image carrier 11, the moving unit 2 that causes the image writing unit 1 to move to the position positioned with respect to the image carrier 11, and the positioning unit 3 that sets the image writing unit 1 in the position positioned with respect to the image carrier 11. Also, such positioning unit 3 has the first position restricting mechanism 4 for restricting a distance between the image carrier 11 and the image writing unit 1, the second position restricting mechanism 5 for restricting the position of the image writing unit 1 in the image moving direction of the image carrier 11, and the third position restricting mechanism 6 for releasing the position restriction of the image writing unit 1 in the width direction of the image carrier 11 under the condition that the position restrictions given by the first position restricting mechanism 4 and the second position restricting mechanism 5 are kept after the position of the image writing unit 1 is restricted in the width direction that intersects orthogonally with the image moving direction of the image carrier 11.

Figure 1B:
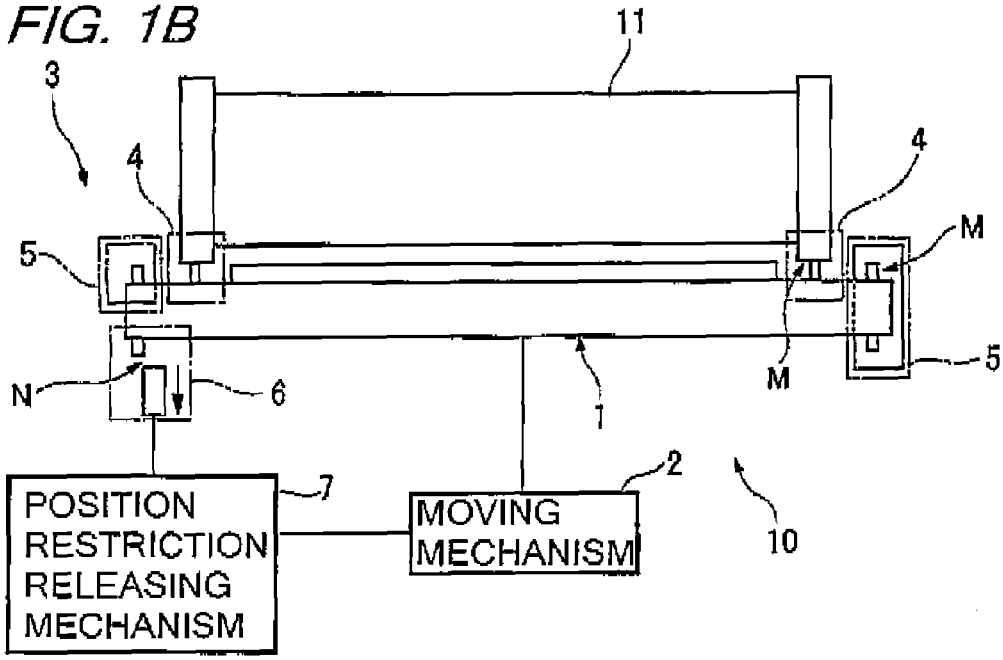

In the present mode, as shown in FIG. 1B, the image writing unit 1 is positioned in a predetermined position in a state that the position of the image writing unit 1 is restricted by the first position restricting mechanism 4 and the second position restricting mechanism 5 (indicated by M in FIG. 1B) and also a state that the position restriction is released after the position is restricted by the third position restricting mechanism 6 (indicated by N in FIG. 1B).

When such positioning system is employed, a failure of the image writing produced in the image writing apparatus according to the comparative mode and caused mainly due to vibrations accompanying a primary mode of an image writing unit 1' may be suppressed.

Here, in order to evaluate the performance of the image writing apparatus 10 according to the present exemplary embodiment, a factor of the failure of the image writing caused in the image writing apparatus in the comparative mode (the mode in which the position restriction releasing mechanism 7 is not provided) will be explained.

Figure 2A:
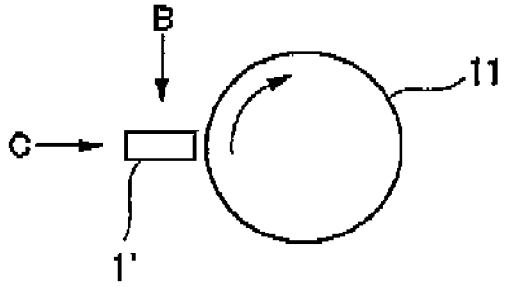
Related Art FIG. 2A
FIGS. 2A to 2D are explanatory view, FIG. 2A showing a drawback of an image writing apparatus used in an image recording apparatus in a comparative mode, FIG. 2B showing the configuration in FIG. 2A viewed from the B direction, FIG. 2C showing the configuration in FIG. 2A viewed from the C direction, and FIG. 2D showing an example of a failure caused when an image is written by the image writing apparatus.

As shown in FIG. 2A, in the image writing apparatus in the comparative mode, the image writing unit 1' (in this example, the LED printer head) is positioned in the positioning position with respect to the image carrier 11 by the positioning unit (not shown) in such a state that the position of the image writing unit 1' is restricted in three directions that intersect orthogonally mutually.

Figure 2B:
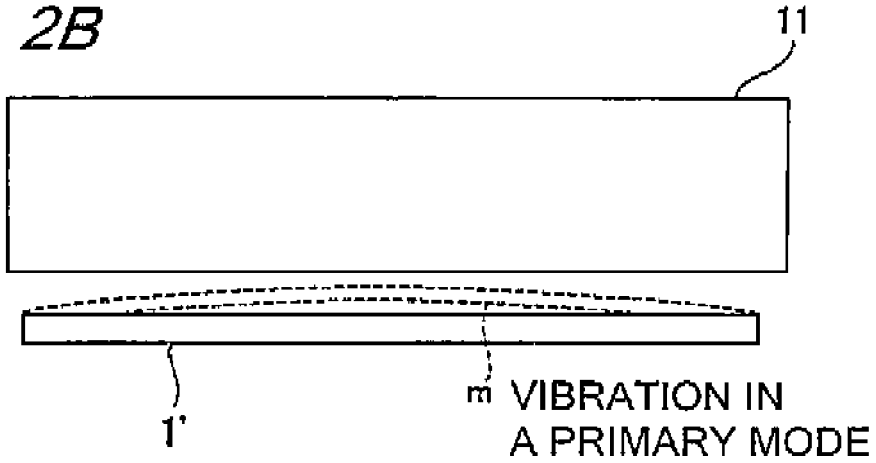
Figure 2C:
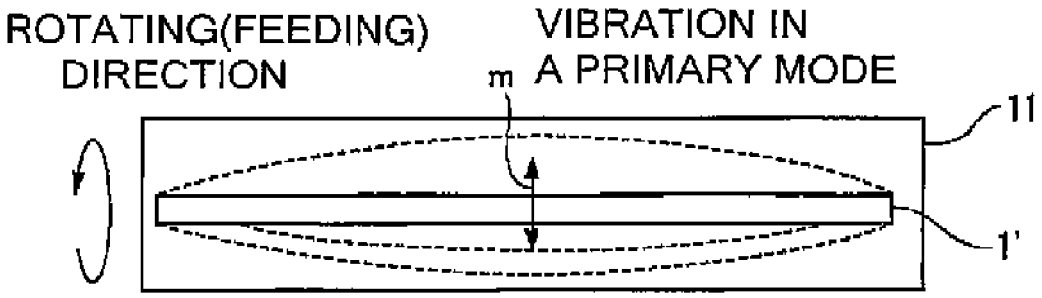
Figure 2D:
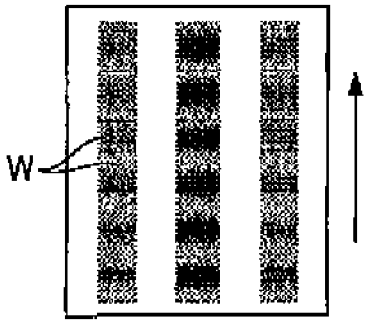

At this time, as shown in FIGS. 2B and 2C, the vibrations propagate to the long image writing unit 1' from the driving transmission system such as the gear, or the like and the vibration m accompanying a primary mode deformation is caused mainly in the image writing unit 1' when the image writing unit 1' resonates accordingly. When the image is written on the image carrier 11 in this state, the failure of the image writing in which unevenness W in density called the so-called banding are conspicuous are caused, as shown in FIG. 2D.

In order to improve such drawback, the present exemplary embodiment intends to improve the configuration of the positioning unit 3 and avoid such a situation that the resonance of the image writing unit 1 is caused.

The present invention will be explained in more detail based on exemplary Embodiment shown in the accompanying drawings hereinafter.

Exemplary Embodiment 1

—Overall Configuration of Image Recording Apparatus—

Figure 3:
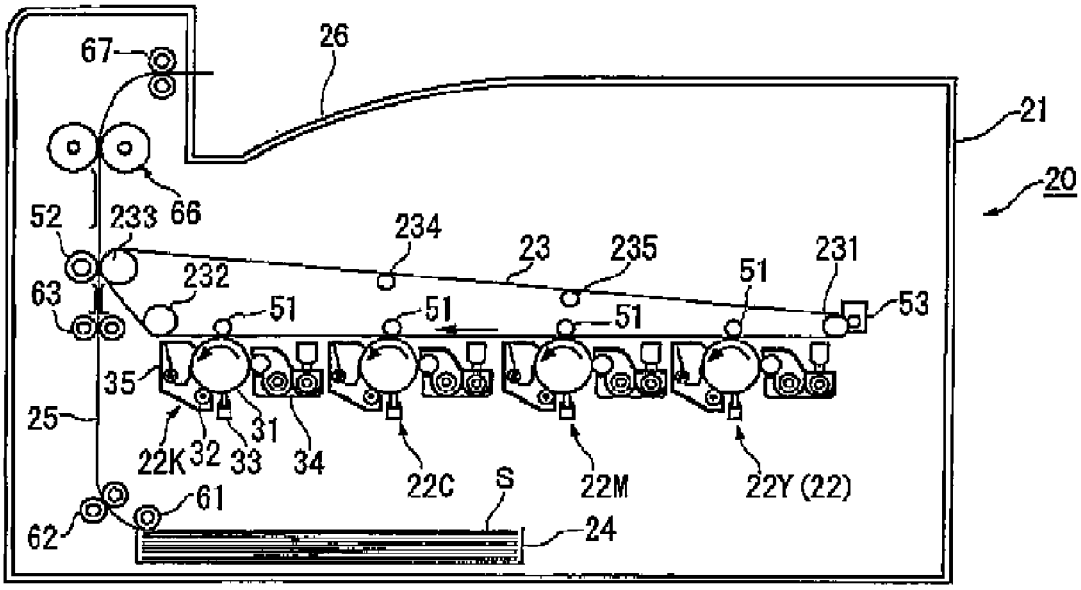
FIG. 3 is an explanatory view showing an overall configuration of an image recording apparatus according to exemplary Embodiment 1.

FIG. 3 is an explanatory view showing an overall configuration of exemplary Embodiment 1 of an image recording apparatus to which the present invention is applied.

In FIG. 3, an image recording apparatus 20 is constructed such that image forming portions 22 (concretely 22Y to 22K) in four colors (in the present exemplary embodiment, yellow, magenta, cyan, black) are aligned in the substantially horizontal lateral direction in an apparatus housing 21, an intermediate transfer belt 23 that is circulated and carried along the aligning direction of the image forming portions 22 is provided over the image forming portions, a recording material supplying unit 24 in which the recording materials are contained to supply is provided at the bottom of the apparatus housing 21, an output recording material receiver 26 in which recording materials S on which the image has already been formed are output and contained is provided at the top of the apparatus housing 21, and the recording materials S supplied from the recording material supplying unit 24 are output into the output recording material receiver 26 via a recording material carrying path 25 that is extended along in the substantially vertical direction.

In the present exemplary embodiment, as shown in FIG. 3, respective image forming portions 22 (22Y to 22K) are provided in order from the upstream side in the circulating direction of the intermediate transfer belt 23 to form the toner images in yellow, magenta, cyan, black colors, for example (the alignment is always limited to this order). For example, a photosensitive body 31 farmed like a drum, a charger 32 for charging previously this photosensitive body 31, an image write head 33 for writing an electrostatic latent image on the photosensitive body 31 being charged by the charger 32, a developer 34 for visualizing the electrostatic latent image on the photosensitive body 31 into the visual image in each color, and a cleaner 35 for cleaning the residual toner on the photosensitive body 31 are provided in each color.

Here, in this example, the photosensitive body 31 is constructed as the image forming assembly (process cartridge) in which the photosensitive body 31 is integrated together with the charger 32, the developer 34, and the cleaner 35.

Also, the intermediate transfer belt 23 is stretched on tension rollers 231 to 235, and is circulated/moved by the tension roller 231 acting as the driving roller, for example. Then, a primary transfer unit 51 (e.g., primary transfer roller) is provided at the back surface of the intermediate transfer belt 23 to correspond to the photosensitive bodies 31 respectively. When a voltage with the opposite polarity to the charged polarity of the toner is applied to the primary transfer unit 51, the toner image on the photosensitive body 31 is transferred electrostatically on the intermediate transfer belt 23 side.

Further, a secondary transfer unit 52 (e.g., a secondary transfer roller) is provided to the portion of the intermediate transfer belt 23, which corresponds to the tension roller 233 on the downstream side of the image forming portion 22K that is located on the most downstream side in the moving direction of the intermediate transfer belt 23. Thus, the primary transfer images on the intermediate transfer belt 23 are secondarily transferred (simultaneously transferred) on the recording material.

Further, an intermediate cleaner 53 for cleaning the residue toner on the intermediate transfer belt 23 is provided to the portion of the intermediate transfer belt 23, which corresponds to the tension roller 231 on the downstream side of the secondary transfer portion of the intermediate transfer belt 23.

Further, in the present exemplary embodiment, the recording material S fed by a feeder 61 of the recording material supplying unit 24 is carried by an appropriate number of carrying rollers 62 in the recording material carrying path 25, then is aligned by a register roller 63 and then passed through the secondary transfer portion of the secondary transfer unit 52, then the unfixed toner images are fixed by applying a heat and a pressure by means of fixing units 66, for example, and then the recording material S is output/contained in the output recording material receiver 26 via outputting rollers 67.

—Image Write Head—

Figure 4:
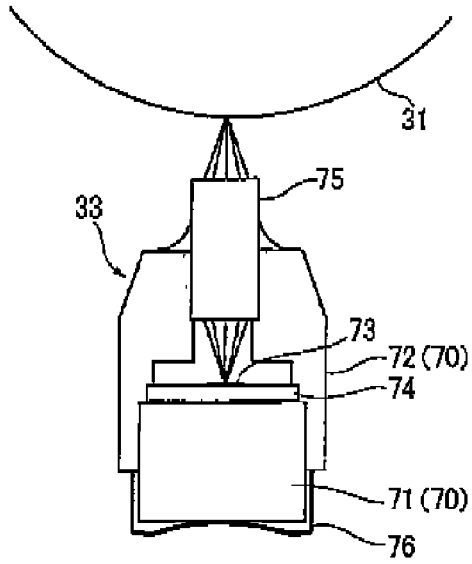
FIG. 4 is an explanatory view showing an example of an image writing apparatus used in exemplary Embodiment 1.
Figure 5:
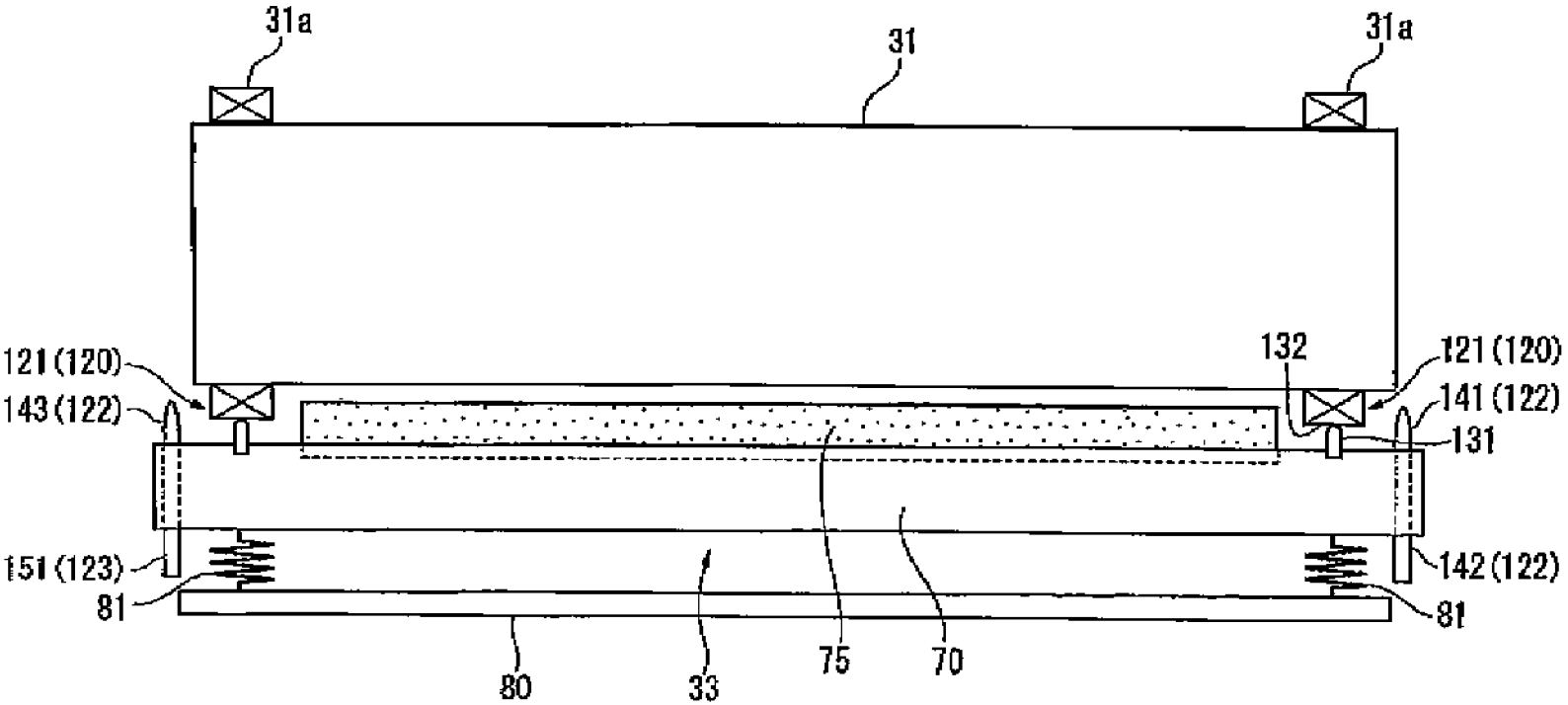
FIG. 5 is an explanatory view showing a relation between an image writing unit and a photosensitive body in the image writing apparatus used in exemplary Embodiment 1.

Also, in the present exemplary embodiment, as shown in FIG. 4, the image write head 33 has a base member 71 that extends along the axial direction of the photosensitive body 31. A holder member 72 is fitted to the base member 71, and a substrate 74 on which LEDs 73 are aligned at a predetermined pitch interval is held in the holder member 72. Also, a conversing lens (Selfoc lens) 75 is held between the LEDs 73 on the substrate 74 of the holder member 72 and the photosensitive body 31 respectively such that a light from each LED 73 on the substrate 74 is converged/focused onto the photosensitive body 31 respectively. In FIG. 4, a reference numeral 76 denotes a pushing spring that applies a pushing to the base member 71 toward the holder member 72 side, and the base member 71 and the holder member 72 are integrated as a head main body Also, as shown in FIG. 5, the image write head 33 is elastically supported on a supporting bracket 80 fixed to the apparatus main body via pushing springs 81, for example.

—Retracting Mechanism—

Figure 6:
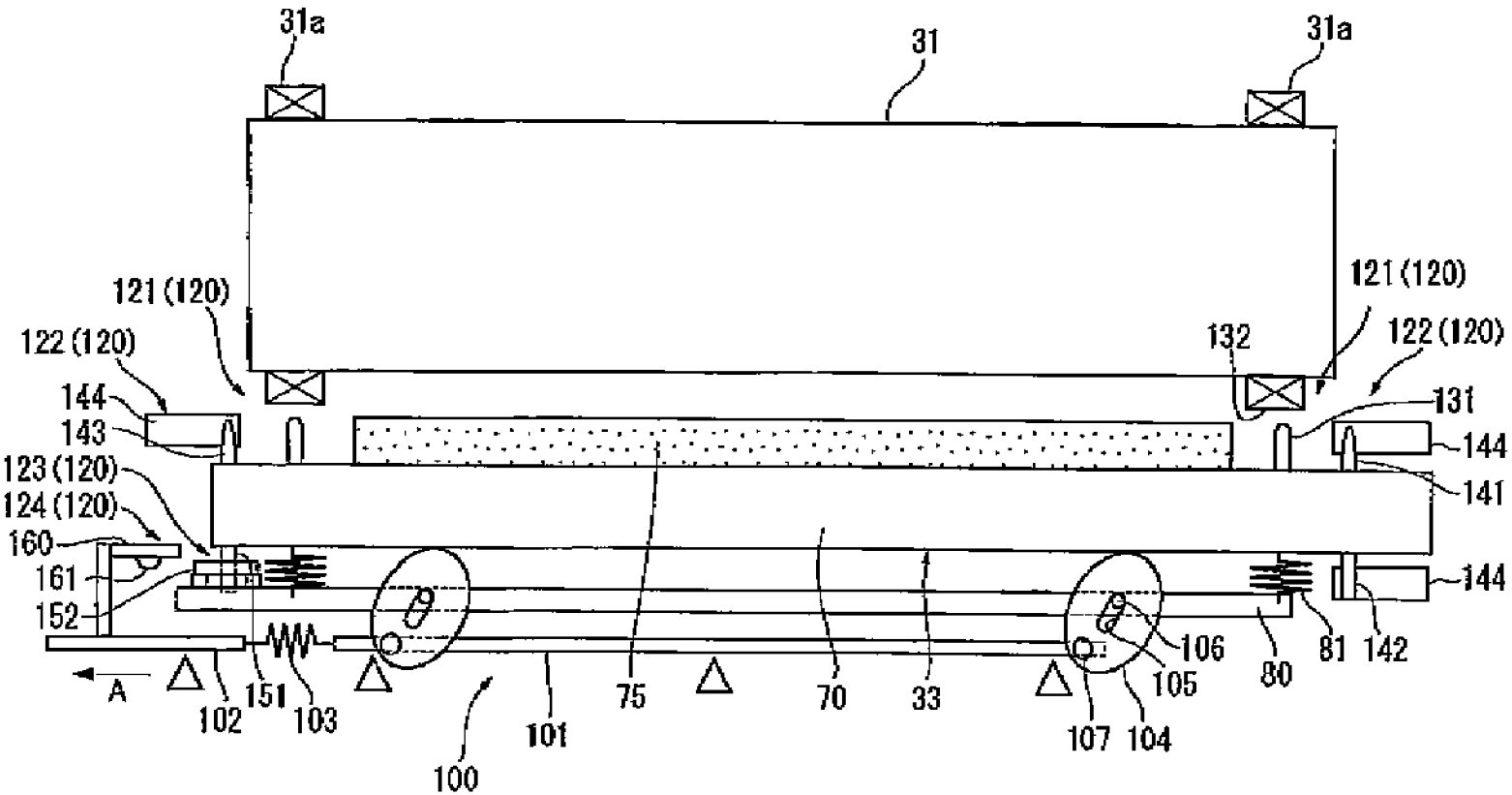
FIG. 6 is an explanatory view showing an example of a moving unit and a positioning unit in the image writing apparatus used in exemplary Embodiment 1.

In the present exemplary embodiment, as shown in FIG. 6, the image write head 33 is supported by a retracting mechanism (moving unity) 100 that is moved back and forth between the positioning position facing to the photosensitive body 31 and the standby position that is retracted from the positioning position.

This retracting mechanism 100 has a moving rod 101 that extends in the longitudinal direction of the image write head 33 (corresponding to the axial direction of the photosensitive body 1). An operation lever 102 that moves back and forth along the axial direction of the moving rod 101 is coupled to this moving rod 101 via an elastic spring 103. Also, a pair of pivots 106 is fixedly provided to the portions of the supporting bracket 80, which correspond to neighborhoods on both sides in the longitudinal direction of the moving rod 101. A pair of eccentric cams 104 each formed as a substantially elliptic shape are fitted rotatably on the pivot 106 via a longitudinal hole 105 respectively. The head main body 70 of the image write head 33 is supported by the eccentric cams 104, and a part of the eccentric cams 104 is coupled to the moving rod 101 via pins 107.

In the present exemplary embodiment, as shown in FIG. 6, when the operation lever 102 is pulled in the direction indicated with an arrow A, the moving rod 101 is pulled in the direction indicated with an arrow A via the elastic spring 103, and then the retracting mechanism 100 arranges the eccentric cams 104 obliquely in this state such that its major axis is inclined obliquely.

At this time, the image write head 33 is arranged in the standby position that is retreated from the positioning position to the photosensitive body 31.

—Positioning Mechanism—

Also, in the present exemplary embodiment, as shown in FIG. 5 and FIG. 6, a positioning unit 120 for positioning the image write head 33 in the positioning position to the photosensitive body 31 is provided.

This positioning unit 120 has a first restriction member 121 for restricting a distance between the photosensitive body 31 and the image write head 33, a second restriction member 122 for restricting a position of the image write head 33 in the rotating direction of the photosensitive body 31, and a third restriction member 123 for restricting a position of the image write head 33 in the axial direction of the image write head 33.

Here, the first restriction member 121 has a position restricted pin 131 that is protruded toward the photosensitive body 31 side near both sides of the head main body 70 of the image write head 33 in the longitudinal direction respectively. An outer peripheral surface of a bearing member (bearing) 31*a*, which supports rotatably the surface of the photosensitive body 31, acts as a position restricting wall 132 on the photosensitive body 31 side respectively. The first restriction member 121 performs the position restriction in the first direction by bringing the position restricted pin 131 into contact with the position restricting wall 132.

Further, in the present example, the top end portion of the position restricted pin 131 is formed as the curved surface to reduce a contact area to the position restricting wall 132. Also, the pushing spring 81 acts to push the position restricted pin 131 against the position restricting wall 132.

Figure 8A:
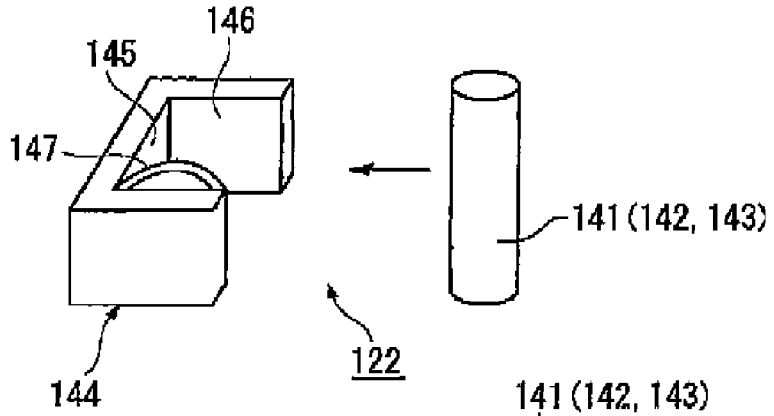
FIGS. 8A and 8B are explanatory views, FIG. 8A showing a configurative example of a first restriction member, and FIG. 8B being an explanatory plan view showing the configuration in FIG. 8A.
Figure 8B:
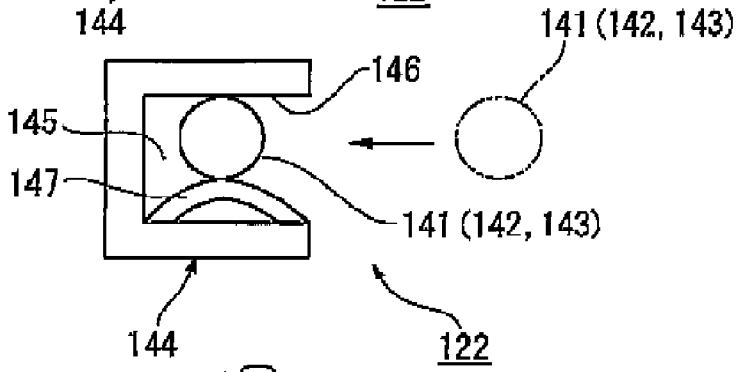

Also, the second restriction member 122 has position restricted pins 141, 143, which are projected toward the photosensitive body 31 side, near both ends of the head main body 70 of the image write head 33 in the longitudinal direction, and also has a position restricted pin 142, which is projected in the direction to become distant from the photosensitive body 31, on the opposite side of the head main body 70 to the position restricted pin 141. For example, as shown in FIGS. 8A and 8B, a position restricting holder 144 into which the position restricted pins 141 to 143 are fitted is provided to the process cartridges on the photosensitive body 31 to correspond to these position restricted pins 141 to 143 respectively. The positions of the position restricted pins 141 to 143 are restricted by the position restricting holders 144.

Here, the position restricting holder 194 has a U-shaped groove 145 into which the position restricted pins 141 to 143 are fitted, for example. One inner wall of the U-shaped groove 145, for example, is used as a position restricting wall 146, and also a leaf spring 147, for example, is fitted to the other inner wall opposing to the position restricting wall 146. Since the position restricted pins 141 to 143 are put between the position restricting wall 146 and the leaf spring 147, the positions of the position restricted pins 141 to 143 are restricted at three points with respect to the position restricting wall 146.

Then, the section of the position restricted pins 141 to 143 is formed as a circular shape to reduce a contact area to the position restricting wall 132.

In the present exemplary embodiment, the position restricted pins 141, 142 are constructed by piercing/arranging one pin member through the head main body 70. Also, the position restricted pin 143 may be provided singly to the head main body 70. In the present exemplary embodiment, the position restricted pin 143 is constructed by piercing/arranging a position restricted pin 152 of the third restriction member 123, described later, and one pin member through the head main body 70.

Also, the third restriction member 123 has the position restricted pin 151, which is projected in the direction to become distant from the photosensitive body 31, near one side portion of the head main body 70 of the image write head 33 in the longitudinal direction respectively. A position restricting plate 152 formed of a leaf spring that is elastically deformable (see FIG. 7) is provided to the process cartridge that corresponds to this position restricted pin 151 on the photosensitive body 31.

Figure 9A:
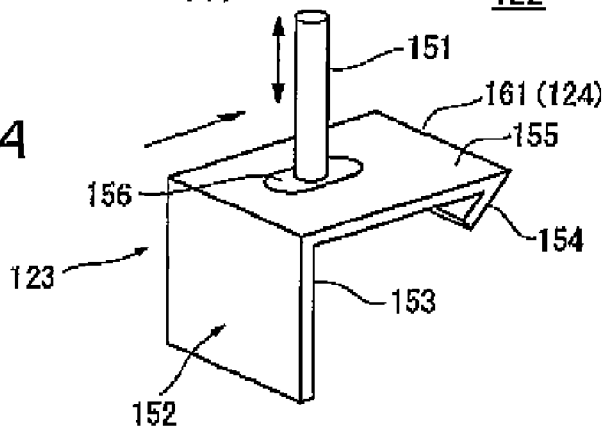
FIGS. 9A and 9B are explanatory views, FIG. 9A showing a configurative example of a third restriction member, and FIG. 9B being an explanatory view showing an operational example from a third position restricted state to a restriction released state of the image writing unit
Figure 9B:
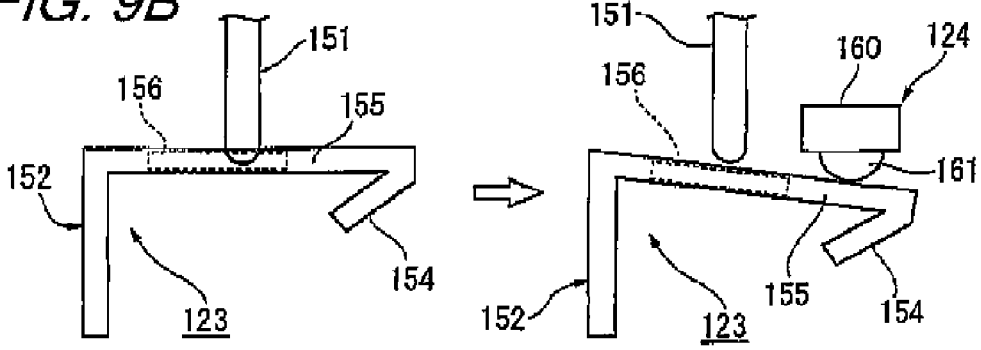

Here, as shown in FIGS. 9A and 9B, the position restricting plate 152 is constructed by forming a folded portion 154 at the top end of an elastic plate member 153 whose section is formed like a substantial L-shape, fixing a base end of the elastic plate member 153 to a predetermined fixing portion, arranging an elastically deformable elastic bending piece 155 at the location that opposes to the position restricted pin 151, providing a longitudinal position restricting hole 156, which extends in the moving direction of the moving rod 101 of the retracting mechanism 100, in the elastic bending piece 155, and inserting/arranging the top end portion of the position restricted pin 151 into the position restricting hole 156. In the present example, the position restricted pin 152 is constructed such that its section is formed into a circular shape and its top end portion is formed as the curved surface portion.

In the present example, as shown in FIG. 6, the operation lever 102 of the retracting mechanism 100 is pulled in the direction indicated with an arrow A, the image write head 33 is retracted from the positioning position to the standby position. At this time, the third restriction member 123 brings the position restricted pin 151 in touch with to one end of the position restricting hole 156 of the position restricting plate 152, and thus restricts the position of the photosensitive body 31 in the axial direction.

Further, in the present exemplary embodiment, the positioning unit 120 has a position restriction releasing mechanism 124 that releases the position restriction imposed by the third restriction member 123 after the image write head 33 is positioned in the positioning position facing to the photosensitive body 31 by the first to third restriction members 121 to 123.

As shown in FIGS. 9A and 9B, this position restriction releasing mechanism 124 is constructed such that a substantial L-shaped releasing lever 160 is provided integrally with the operation lever 102 of the retracting mechanism 100, and a substantially hemispherical convex portion 161 is provided to the portion of this releasing lever 160 opposing to the elastic bending piece 155 such that the substantially hemispherical convex portion 161 is brought into contact with the folded portion 154 and its neighborhood out of the elastic bending piece 155 of the third restriction member 123. As a result, as shown in FIG. 7, when the operation lever 102 is moved in the direction indicated with an arrow B, the releasing lever 160 causes the elastic bending piece 155 to elastically deform downward via the hemispherical convex portion 161 following upon the movement of this releasing lever 160, and correspondingly the position restricted pin 151 is pulled out (separated) from the position restricting hole 156 of the elastic bending piece 155.

In this case, the folded portion 154 of the elastic bending piece 155 has high rigidity, so that the elastic bending piece 155 is pushed down together by the releasing lever 160 and the convex portion 161 and correspondingly the releasing operation of the position restricted pin 151 from the position restricting hole 156 is made stably. Also, the convex portion 161 is provided to the releasing lever 160 side, but the provision of the convex portion 161 is not limited to this mode. The convex portion 161 may be provided to not the releasing lever 160 side but the elastic bending piece 155 side, otherwise the convex portion 161 may be provided to both sides respectively.

Next, processes in the positioning operation of the image write head according to the present exemplary embodiment will be explained hereunder.

Here, as shown in FIG. 6, when the operation lever 102 of the retracting mechanism 100 is moved in the direction indicated with an arrow A, the image write head 33 is set to the standby position that is a way from the positioning position facing to the photosensitive body 31.

At this time, in the positioning unit 120, the position restriction given by the first restriction member 121 is not applied, but the position restriction given by the second restriction member 122 and the position restriction given by the third restriction member 123 are applied. Therefore, the image write head 33 is subjected to the position restriction by the second restriction member 122 and the third restriction member 123 of the positioning unit 120, but the image write head 33 is not positioned in the positioning position to the photosensitive body 31.

Figure 7A:
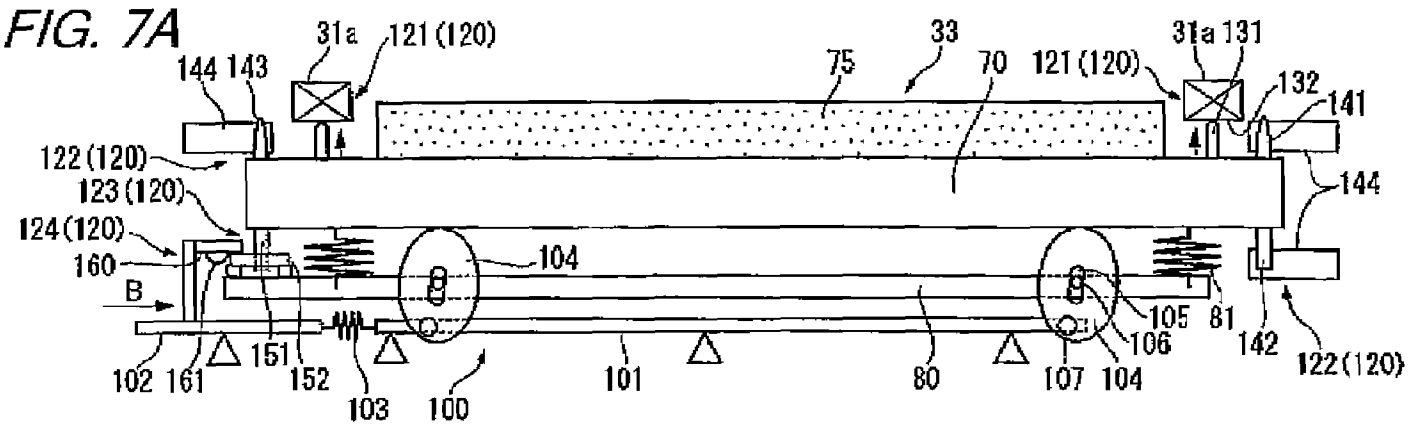
FIGS. 7A and 7B are explanatory views, FIG. 7A showing processes of a positioning operation in the image writing apparatus according to exemplary Embodiment 1, and FIG. 7B showing a state at a time of positioning of the image writing apparatus.
Figure 7B:
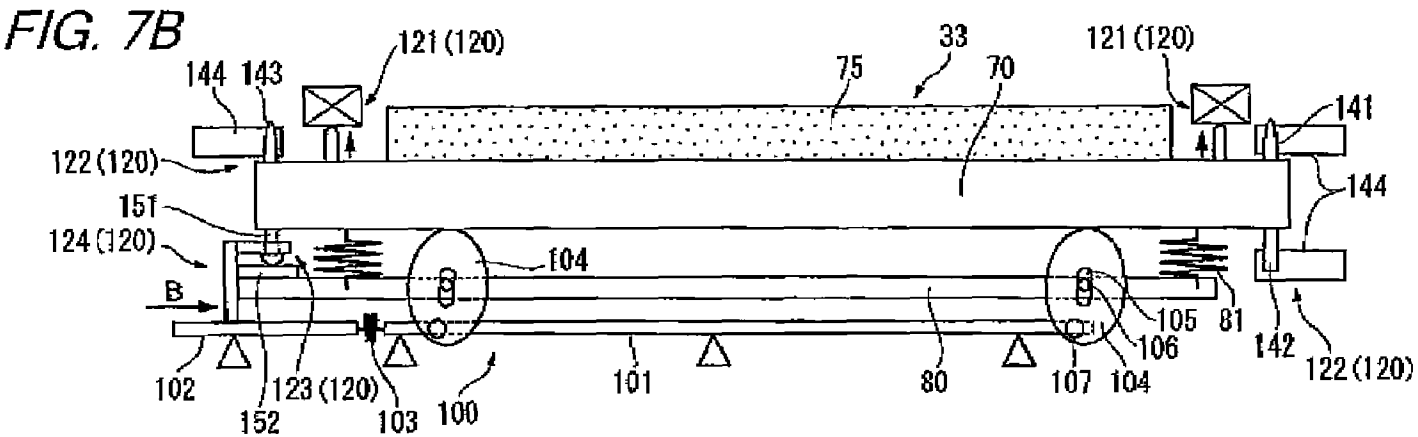

Then, upon positioning the image write head 33 in the positioning position to the photosensitive body 31, as shown in FIGS. 7A and 73, the operation lever 102 of the retracting mechanism 100 may be moved in the direction indicated with an arrow B.

At this time, in the retracting mechanism 100, as shown in FIG. 7A, the moving rod 101 moves in the direction indicated with an arrow B following upon the movement of the operation lever 102. Then, the attitude of the eccentric cams 104 that are arranged obliquely is changed gradually to the standing pose, and the image write head 33 comes close to the photosensitive body 31 side. Then, the position restricted pin 131 of the first restriction member 121 contacts the position restricting wall 132 of the bearing member 31*a*, and the position restricted pin 131 is pushed against the position restricting wall 132 by a spring force of the pushing spring 81, and the position restriction is applied by the first restriction member 121 in this state. As a result, a distance between the photosensitive body 31 and the image write head 33 is kept constant, and the focusing of the image write head 33 is adjusted.

In this state, the image write head 33 is moved to come close to the photosensitive body 31 side, and the position restriction imposed by the second restriction member 122 is continuously executed. Also, as shown in FIG. 7A and FIG. 9A, the position restricted pin 151 moves upwardly as the image write head 33 is moved to come close to the photosensitive body 31 side. However, the third restriction member 123 does not come out of the position restricting hole 156, and the position restriction imposed by the third restriction member 123 is still continuously executed.

Therefore, in a state shown in FIG. 7A, the position of the image write head 33 is restricted by respective position restricting mechanisms 121 to 121 to 123 as the positioning unit 120, and the image write head 33 is positioned in the positioning position facing to the photosensitive body 31.

Then, as shown in FIG. 7E, when the operation lever 102 of the retracting mechanism 100 is moved further in the direction indicated with an arrow B, the moving rod 101 is never moved because the position restriction imposed by the first restriction member 121 has already been completed. Thus, the elastic spring 103 is compressed/deformed according to the movement of the operation lever 102.

In contrast, the releasing lever 160 of the position restriction releasing mechanism 124 is also moved in the direction indicated with an arrow B, following upon the movement of the operation lever 102 in the direction indicated with an arrow B. Therefore, as shown in FIG. 9B, the elastic bending piece 155 of the position restricting plate 152 is elastically deformed and is pushed down. An amount of this downward pushing may be selected in advance such that an amount of elastic displacement required when the position restricted pin 151 comes out of the position restricting hole 156 of the elastic bending piece 155 is ensured. As a result, the position restriction imposed by the third restriction member 123 is released, and finally the positioning unit 120 is operated in such a way that the position restriction imposed by the third restriction member 123 is released but the position restriction imposed by the first and second restriction members 121, 122 is still kept.

In this state, since the position restriction imposed by the first restriction member 121 is still kept, a contact frictional force is being applied between the position restricted pin 131 and the position restricting wall 132 of the bearing member 31*a* and also this contact frictional force is being applied in the axial direction of the image write head 33. As a result, even when the position restriction imposed by the third restriction member 123 is released, it is seldom feared that the image write head 33 moved along the axial direction of the photosensitive body 31.

In the present exemplary embodiment, the image write head 33 is positioned in the positioning position to the photosensitive body 31 in a state that the position restriction of the third restriction member 123 is released but the position restriction of the first and second restriction members 121, 122 is still imposed. Therefore, it is confirmed that, even though vibrations generated from the gear, etc. act to the image write head 33, the vibration caused due to the primary mode deformation is suppressed small because of the release of the position restriction by the third restriction member 123.

This is supported by Example described hereunder.

EXAMPLE

Example 1

A mode in which the positioning mechanism of the image write head according to exemplary Embodiment 1 is employed is selected as Example 1. The center portion of the image write head being supported/forced in the image forming condition is vibrated by the already-known force, and variation in natural frequencies is examined by an impact test that is applied to evaluate a response of an acceleration sensor attached to the center portion of the image write head. The results shown in FIG. 10A are obtained.

Also, in evaluating the performance Example 1, the variation in natural frequencies in Comparative Example 1 (a mode in which the position restriction releasing mechanism for the third restriction member is not provided) is similarly examined.

Figure 10A:
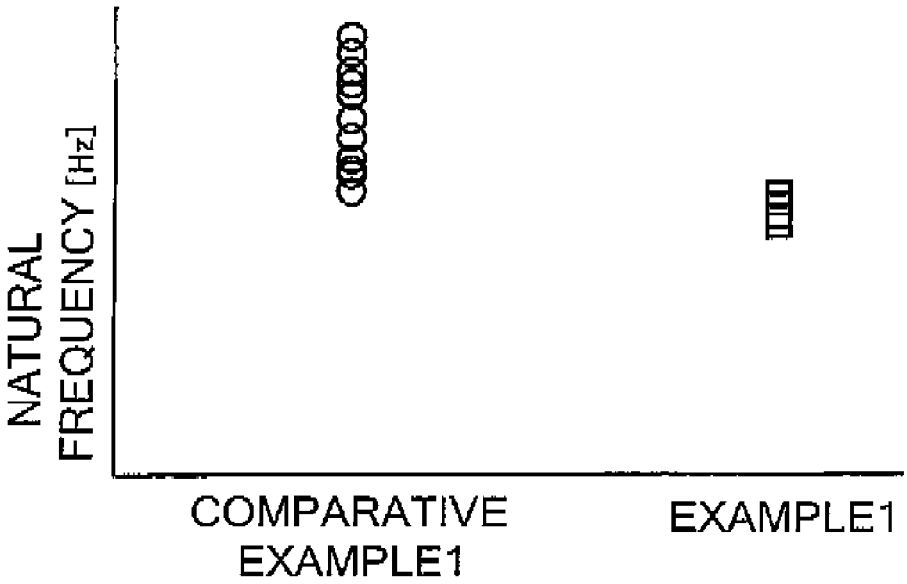
FIGS. 10A and 10B are an explanatory view, FIG. 10A showing variation in natural frequencies of the image writing apparatuses according to Example 1 and Comparative Example 1, and FIG. 10B showing the spatial frequency characteristics of the image writing apparatuses according to Comparative Example 1.

According to FIG. 10A, it is understood that the variation in natural frequencies is suppressed in Example 1 in contrast to Comparative Example 1.

Also, in Comparative Example 1, the variation in natural frequencies is examined in the characteristic graph showing a relation between the spatial frequency and the speed variation. The results shown in FIG. 10A are obtained.

Figure 10B:
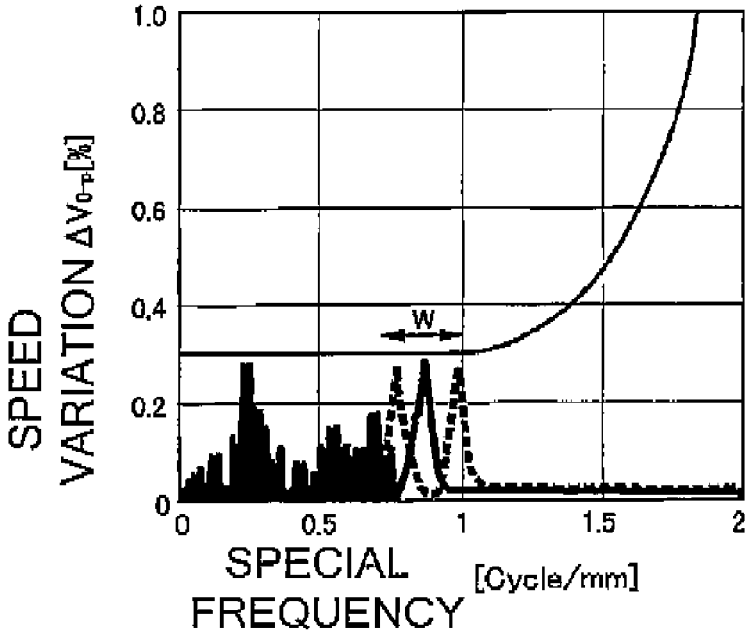

According to FIG. 10B, the area indicated with an arrow W in FIG. 10B shows a variation width of the natural frequency, and it is understood that the variation in natural frequencies is large.

The foregoing description of the exemplary embodiment of the present invention has been provided for the purpose illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. An image writing apparatus comprising:

an image writing unit that faces an image carrier or a support member supporting a recording medium and that writes an image on the image carrier or the recording medium;

a moving unit that moves the image writing unit between a first position and a second position apart from the first position; and a positioning unit that sets the image writing unit in the first position and that includes a first restriction member, a second restriction member, a third restriction member, and a restriction releasing portion, wherein the first restriction member restricts a first movement of the image writing unit along a first direction from the image carrier to the image writing unit or from the support member to the image writing unit, the second restriction member restricts a second movement of the image writing unit along a second direction perpendicular to the first direction and an axial direction of the image carrier or the support member, the third restriction member restricts a third movement of the image writing unit along a third direction parallel to the axial direction, and the restriction releasing portion releases the third movement after the image writing unit is set in the first position by the first to third restriction member.

2. The image writing apparatus according to claim 1, wherein the moving unit moves the image writing unit so that the first restriction member restricts the first movement after the second restriction unit and the third restriction unit restrict the second movement and the third movement.

3. The image writing apparatus according to claim 1, wherein the first restriction unit has a position restricted member on a image writing unit side where the image writing unit is disposed, and has a position restricting member on a recording apparatus main body side where the image carrier or the support member is disposed, the position restricted member contacting the position restricting member when the image writing unit is set in the first position.

4. The image writing apparatus according to claim 3, wherein the first restricting unit has a pushing member pushing the position restricted member against the position restricting member.

5. The image writing apparatus according to claim 1, wherein each of the first to third restriction unit has a position restriction member and a position restricted member having a contact portion to be contacted the position restricting member, the contact portion being formed as a curved face.

6. The image writing apparatus according to claim 1, wherein the third restriction member has a position restricted member on a image writing unit side where the image writing unit is disposed, and has a position restricting member on a recording apparatus main body side where the image carrier or the support member is disposed, the position restricted member contacting the position restricting member when the image writing unit is set in the first position, the position restricted member disengaging from the position restricting member according to an elastic deformation of the position restricting member.

7. The image writing apparatus according to claim 1, wherein the third restriction unit restricts and releases the third movement with a movement of the image writing unit by the moving unit.

8. The image writing apparatus according to claim 7 further comprising a releasing unit that has a releasing member moving along with the moving unit, the releasing member operating the third restriction unit so as to release the third movement, wherein the third restriction member releases the third movement after the image writing unit is set in the first position by the first to third restriction member.

9. An image writing apparatus comprising:

an image writing unit that faces an image carrier or a support member supporting a recording medium and that writes an image on the image carrier or the recording medium;

a moving unit that moves the image writing unit to a first position; and a positioning unit that sets the image writing unit in the first position and that includes a first restriction member, a second restriction member, and a third restriction member, wherein the first restriction member restricts a first movement of the image writing unit along a first direction from the image carrier to the image writing unit or from the support member to the image writing unit, the second restriction member restricts a second movement of the image writing unit along a second direction perpendicular to the first direction and an axial direction of the image carrier or the support member, and after the third restriction member restricts a third movement of the image writing unit along a third direction parallel to the axial direction, the third restriction member releases the third movement while the first restriction member and the second restriction member restrict the first movement and the second movement.

10. The image writing apparatus according to claim 9, wherein the moving unit moves the image writing unit so that the first restriction member restricts the first movement after the second restriction unit and the third restriction unit restrict the second movement and the third movement.

11. The image writing apparatus according to claim 9, wherein the first restriction unit has a position restricted member on a image writing unit side where the image writing unit is disposed, and has a position restricting member on a recording apparatus main body side where the image carrier or the support member is disposed, the position restricted member contacting the position restricting member when the image writing unit is set in the first position.

12. The image writing apparatus according to claim 11, wherein the first restricting unit has a pushing member pushing the position restricted member against the position restricting member.

13. The image writing apparatus according to claim 9, wherein each of the first to third restriction unit has a position restriction member and a position restricted member having a contact portion to be contacted the position restricting member, the contact portion being formed as a curved face.

14. The image writing apparatus according to claim 9, wherein the third restriction member has a position restricted member on a image writing unit side where the image writing unit is disposed, and has a position restricting member on a recording apparatus main body side where the image carrier or the support member is disposed, the position restricted member contacting the position restricting member when the image writing unit is set in the first position, the position restricted member disengaging from the position restricting member according to an elastic deformation of the position restricting member.

15. The image writing apparatus according to claim 9, wherein the third restriction unit restricts and release the third movement with a movement of the image writing unit by the moving unit.

16. The image writing apparatus according to claim 15 further comprising a releasing unit that has a releasing member moving along with the moving unit, the releasing member operating third restriction unit so as to release the third movement, wherein the third restriction member releases the third movement after the image writing unit is set in the first position by the first to third restriction member.

17. An image recording apparatus comprising:

an image carrier or a support member supporting a recording medium, the image carrier being provided in a recording apparatus main body; and an image writing apparatus including:

an image writing unit that faces the image carrier or the support member and that writes an image on the image carrier or the recording medium;

a moving unit that moves the image writing unit between a first position and a second position apart from the first position; and a positioning unit that sets the image writing unit in the first position and that includes a first restriction member, a second restriction member, a third restriction member, and a restriction releasing portion, wherein the first restriction member restricts a first movement of the image writing unit along a first direction from the image carrier to the image writing unit or from the support member to the image writing unit, the second restriction member restricts a second movement of the image writing unit along a second direction perpendicular to the first direction and an axial direction of the image carrier or the support member, the third restriction member restricts a third movement of the image writing unit along a third direction parallel to the axial direction, and the restriction releasing portion releases the third movement after the image writing unit is set in the first position by the first to third restriction member.

* * * * *